US007021091B2

(12) United States Patent
Leyden et al.

(10) Patent No.: US 7,021,091 B2
(45) Date of Patent: Apr. 4, 2006

(54) CABLE SECURITY SYSTEM

(75) Inventors: Roger J. Leyden, Willow Springs, IL (US); Terrance J. Surma, Bloomingdale, IL (US)

(73) Assignee: Se-Kure Controls, inc., Franklin Park, IL (US)

( * ) Notice: Subject to any disclaimer, the term of this patent is extended or adjusted under 35 U.S.C. 154(b) by 0 days.

(21) Appl. No.: 10/441,578

(22) Filed: May 20, 2003

(65) Prior Publication Data

US 2004/0231376 A1 Nov. 25, 2004

(51) Int. Cl.
*E05B 73/00* (2006.01)

(52) U.S. Cl. ..... 70/18; 70/58

(58) Field of Classification Search ..... 70/18, 70/58, 14, 30, 49, 259, 260; 24/115 H, 135 N; 248/551–553; 292/307 R, 308, 315, 319
See application file for complete search history.

(56) References Cited

U.S. PATENT DOCUMENTS 1,358,184 A * 11/1920 Voight ..... 70/259
1,475,256 A * 11/1923 Belair ..... 70/18
1,520,902 A * 12/1924 Junkunc ..... 70/49
1,746,090 A * 2/1930 Rechter ..... 403/206
2,440,012 A * 4/1948 Haver ..... 24/30.5 R
3,251,571 A * 5/1966 Ernest ..... 248/693
3,765,196 A * 10/1973 Balicki ..... 70/49
3,987,653 A * 10/1976 Lyon et al. ..... 70/19
4,212,175 A * 7/1980 Zakow ..... 70/58
4,342,477 A * 8/1982 McClure ..... 292/307 R
4,455,464 A 6/1984 Leyden ..... 200/61.93
4,869,084 A * 9/1989 Mack, Jr. ..... 70/259
4,986,457 A * 1/1991 Faris ..... 223/1
5,070,712 A * 12/1991 Fox ..... 70/18
5,154,072 A 10/1992 Leyden ..... 70/18
5,172,098 A 12/1992 Leyden et al. ..... 340/568
5,181,402 A * 1/1993 Faessler et al. ..... 70/18
D335,439 S 5/1993 Leyden et al. ..... D8/332
5,246,183 A 9/1993 Leyden et al. ..... 242/375
5,279,135 A 1/1994 Leyden et al. ..... 70/18
D345,092 S 3/1994 Leyden et al. ..... D8/332
5,341,124 A 8/1994 Leyden et al. ..... 340/568
5,351,507 A * 10/1994 Derman ..... 70/18
5,421,667 A 6/1995 Leyden et al. ..... 403/406.1
5,517,835 A * 5/1996 Smith ..... 70/14
5,552,771 A 9/1996 Leyden et al. ..... 340/568
5,565,848 A 10/1996 Leyden et al. ..... 340/522
5,577,855 A 11/1996 Leyden et al. ..... 403/291
5,676,258 A 10/1997 Leyden et al. ..... 211/7
5,706,679 A * 1/1998 Zane et al. ..... 70/18
5,823,020 A * 10/1998 Benda ..... 70/18
5,829,280 A * 11/1998 Chen ..... 70/49
6,003,348 A * 12/1999 McCrea ..... 70/18

(Continued)

*Primary Examiner*—Lloyd A. Gall
(74) *Attorney, Agent, or Firm*—Wood, Phillips, Katz, Clark & Mortimer

(57) ABSTRACT

A security system for confining movement of an object to a predetermined area. The security system has a cable, with a length, and a housing. The housing is guidable slidingly along the length of the cable and capable of being fixed at a plurality of different locations spaced along the length of the cable. The cable has a first portion that can be fixed relative to the housing. With the first portion fixed relative to the housing, the cable defines a loop with an effective diameter that is variable by sliding the housing along the length of the cable. The cable has a second portion that can be secured to a support relative to which an object is to be confined by the securing system.

27 Claims, 5 Drawing Sheets

U.S. PATENT DOCUMENTS 6,026,662 A * 2/2000 Schlipper ..... 70/18
6,039,498 A 3/2000 Leyden et al. ..... 403/61
6,087,939 A 7/2000 Leyden et al. ..... 340/568.2
6,212,919 B1 * 4/2001 Gerow ..... 70/18
6,212,922 B1 * 4/2001 Miao ..... 70/58
6,244,081 B1 * 6/2001 Schlipper ..... 70/18
RE37,590 E 3/2002 Leyden et al. ..... 340/568
6,578,394 B1 * 6/2003 Yin ..... 70/58
2004/0065126 A1 * 4/2004 Yang ..... 70/58
2004/0154358 A1 * 8/2004 Yu ..... 70/30

* cited by examiner

CABLE SECURITY SYSTEM

BACKGROUND OF THE INVENTION

1. Field of the Invention

This invention relates to security systems and, more particularly, to a security system utilizing a cable to prevent unauthorized removal of an article from a prescribed area.

2. Background Art

Theft at point of purchase displays continues to be a daunting problem for operators of retail establishments. This is particularly true in the consumer electronics area in which the number, sophistication, and expense of products continue to grow at a rapid rate. As the number and diversity of these products increase, so does the challenge to defeat the efforts of thieves who target these products.

Many different security systems are currently available to store operators. The decision as to whether to purchase a security system, that is suitable for a particular environment, involves the balancing of a number of different considerations, among which are product cost, number of products, historical targeting of particular products, etc. In making the decision as to whether to purchase a security system, the cost of a system that will deter theft of a particular product must be compared to the potential losses otherwise anticipated with respect to that product.

These analyses have led to the design of different types of security systems over the years with different capabilities and a wide cost range. Some basic mechanical systems employ a mechanical cable with spaced ends which are attached to an object to be monitored and a rigid support. The length of the cable dictates the range of permissible movement of the secured object relative to the support. This type of system may be relatively low cost and, while acting as a deterrent to theft, is often defeated by the severance of the cable or the removal of an end connector on the cable from the object being monitored.

More sophisticated monitoring can be performed by electromechanical systems, as shown in U.S. Pat. No. 5,172,098, owned by the assignee herein. Conductive cables are utilized to create monitoring circuits. In the event of the removal of an end connector on the cable from an object, or severance of the cable, a circuit is broken so as to trigger an audible and/or visual alarm which alerts the store operator to a breach. Conventionally, this type of device is utilized on smaller products such as cameras, cellular telephones, etc. The conductive wires are intended primarily to perform an electrical function. While the conductive cables do perform a mechanical restraint function, they are generally of a gauge that allows them to be easily severed. This severance might inadvertently occur as a large or heavy object, with the security system armed, is maneuvered around a store.

It is also well known to construct both mechanical and electrical restraint systems utilizing a cable that is configured in a lasso. This allows the cable to be conveniently installed and released while accommodating potentially a significant range of product size. The lasso arrangement lends itself to being installed on handles and other mechanical configurations which allow passage through of a cable. One form of mechanical lasso is made by doubling over a free end of the cable to form a loop. The loop is maintained by a crimped element, generally made from a soft material so that it will conform to a braided cable surface to be positively held in a fixed position thereon. Typically, the cable is made from a braided metal and has a surrounding rubber sheet. The cable must be sufficiently small in gauge to allow it to be bent over itself to form the loop. As a result, the cable has conventionally been of a size that permits severance by basic tools.

The lasso arrangements utilizing electrical monitoring are not commonly utilized to monitor large objects, such as televisions or the like. As noted above, the cables are prone to being severed both inadvertently by the store personnel as the products are moved, and by a potential thief.

The industry continues to seek out better ways to prevent the theft of articles, such as computer monitors, television sets, etc. The securing of such objects has become even more critical with the advent of expensive high definition and plasma technology, which makes these articles even more inviting to thieves.

SUMMARY OF THE INVENTION

In one form, the invention is directed to a security system for confining movement of an object to a predetermined area. The security system has a cable, with a length, and a housing. The housing is guidable slidingly along the length of the cable and capable of being fixed at a plurality of different locations spaced along the length of the cable. The cable has a first portion that can be fixed relative to the housing. With the first portion fixed relative to the housing, the cable defines a loop with an effective diameter that is variable by sliding the housing along the length of the cable. The cable has a second portion that can be secured to a support relative to which an object is to be confined by the securing system.

In one form, the housing has a body with a through bore through which the cable extends.

In one form, the housing has a receptacle for the first portion of the cable.

In one form, the cable has a free end defining the first portion of the cable.

The housing may have a single piece in which the through bore and receptacle are defined.

In one form, the free end of the cable has a fitting defining a shoulder and a first locking element is directed into the housing with the cable free end in the receptacle. The first locking element abuts to the shoulder to block the fitting in the receptacle.

A second locking element may be provided that is directed into the housing to abut the shoulder to block the fitting in the receptacle.

At least one of the locking elements may be made from a pin that is press fit into the housing.

In one form, the housing is capable of being fixed at the plurality of different locations along the length of the cable by a securing element.

The securing element may be a threaded element that is threadably engaged with the housing.

In one form, the threaded element has a free end that is borne against the cable to fix the housing at the plurality of different locations along the length of the cable.

The threaded element may taper towards a point at the free end.

The cable may be made at least in part from a non-metal material that defines an outer surface of the cable. The free end of the threaded element digs into the outer surface to thereby fix the housing at the plurality of different locations along the length of the cable.

In one form, the cable has a metal core, with a non-metal material surrounding the metal core.

The metal core may be made from braided metal filaments.

In one form, the metal core is made from a hardened material.

In one form, the cable has a metal core, with the fitting crimped to the metal core.

The housing may be made from a non-metal material.

The security system may further be provided in combination with an object to be secured having a portion that is surrounded by the loop defined by the cable.

In one form, the object is a television or a computer monitor.

The security system may further include a connecting assembly for securing the second portion of the cable to a support relative to which an object is to be confined.

DETAILED DESCRIPTION OF THE DRAWINGS

Figure 1:
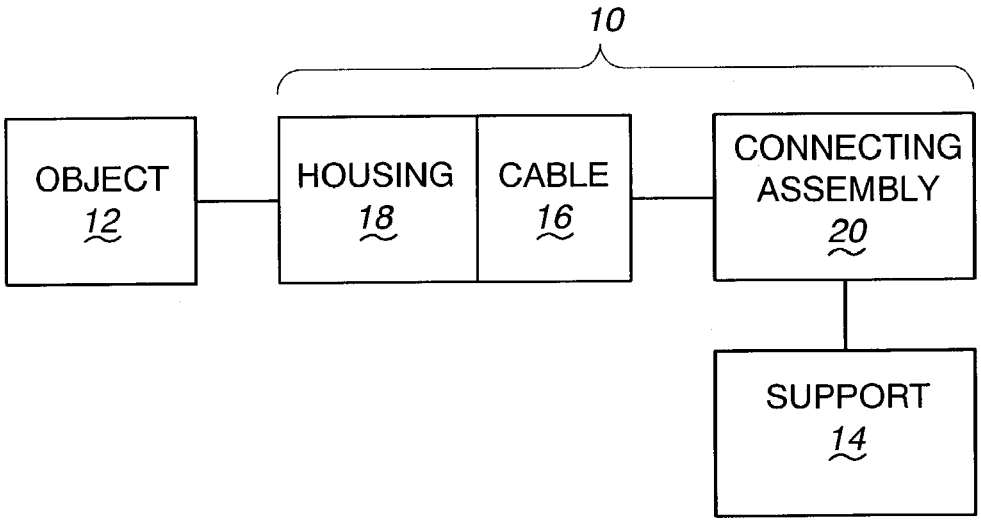
FIG. 1 is a schematic representation of a system, according to the present invention, for securing an object relative to a support.
Figure 2:
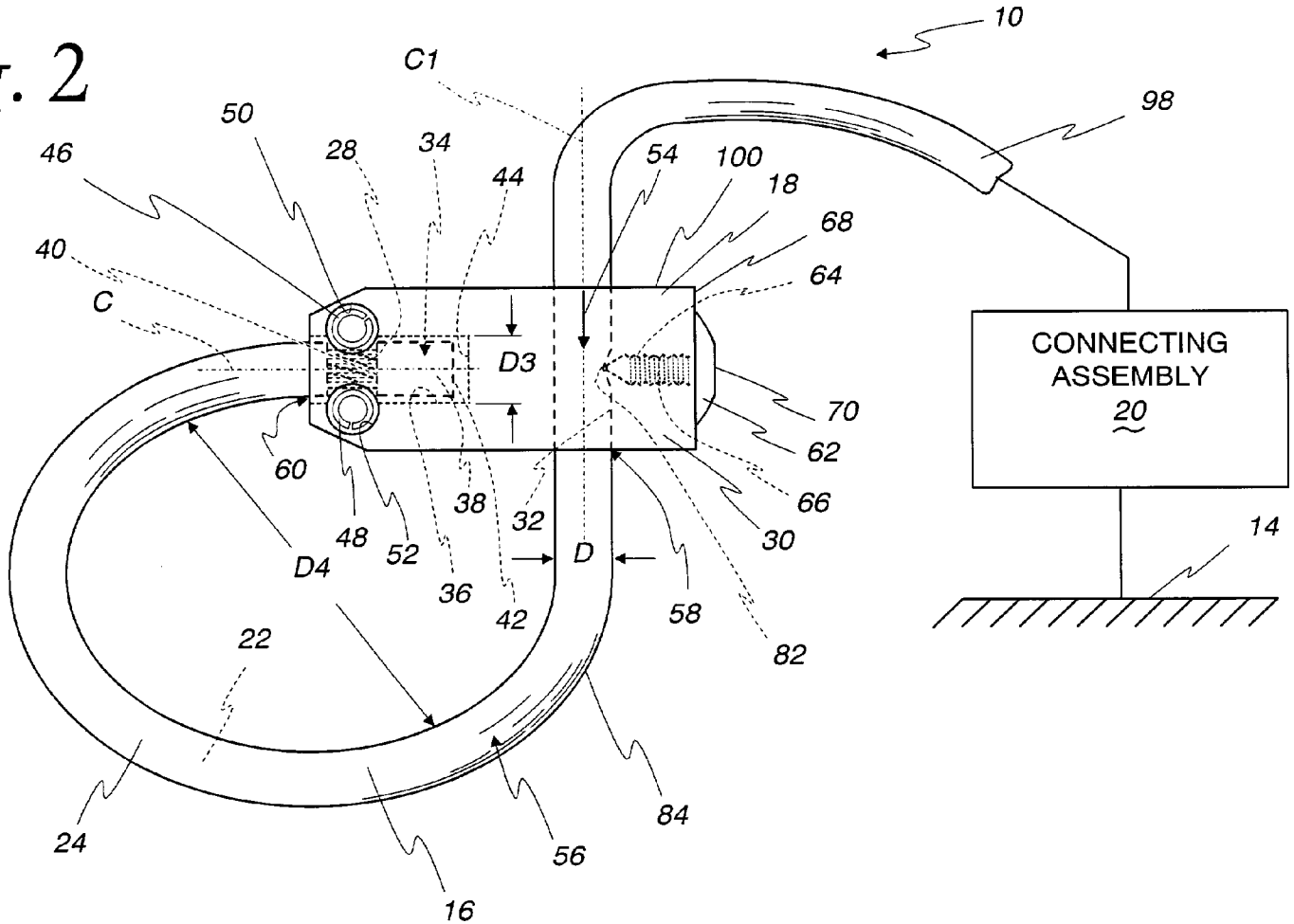
FIG. 2 is a partially schematic representation of one form of security system, according to the present invention, and including a cable, a housing with which the cable cooperates to produce a loop of variable diameter, and a connecting assembly attaching the cable to a support.

In FIG. 1, a security system, according to the present invention, is shown schematically at 10 for confining movement of an object 12 to a predetermined area relative to a support 14. The security system 10 consists of a joined cable 16 and housing 18. The cable 16 is connected to the support 14 through a connecting assembly 20. The object 12 is thus confined in movement relative to the support by a distance dictated by the cable length.

The details of the inventive security system 10 are shown in FIGS. 2–7. As shown in those figures, the cable 16 has a length which is chosen based upon the particular application. Similarly, the diameter D of the cable 16 may vary over a wide range. In one exemplary form, the cable 16 has a metal core 22 and a surrounding coating 24. The metal core 22 is made from braided wire filaments 26. In one form, a plurality of the wire filaments 26 are bundled and spirally wrapped to produce metal cords, which in turn are spirally wrapped to produce the cylindrical core shape shown. The metal core 22, as shown in the stripped away portions of the cable at 28 in FIGS. 2, 4, and 5, has a diameter D1 which may be on the order of 3/16 inch. The coating 24 may have a thickness to increase the outside diameter D to 0.34 inches. Of course, these are just exemplary dimensions, as virtually any other diameter that permits the degree of bending of the cable 16 and the attachment as hereinafter described, is contemplated. The particular metal material making up the filaments 26 may be hardened metal, such as that used for aircraft cable. The coating/sleeve 24 may be a hard rubber or plastic material.

The housing 18 is shown to have a body 30 with a generally squared shape. The particular shape is unimportant and could be round, or otherwise. The body 30 has a through bore 32 formed therein. The through bore 32 is dimensioned to allow the cable 16 to slide guidingly therethrough without significant resistance.

The cable 16 has a first portion 34, shown at the free end thereof, which is received in a receptacle 36 on the body 30. The receptacle 36 is defined by a blind bore having a diameter D3 that sufficiently large to accept a fitting/connector 38 that is crimped at the free end 34 of the cable 16. The central axis C of the blind bore defining the receptacle 36 is orthogonal to the central axis C1 of the through bore 32, though this is not required. A portion of the coating 24 is stripped adjacent to the cable free end 34 to allow the fitting/connector 38 to be placed thereover and crimped. A suitable material for the fitting/connector 38 is preferably soft enough to be formed into the contours of the metal core 22 as it is compressed inwardly therearound by an appropriate tool (not shown).

The fitting/connector 38 defines an annular shoulder 40 around the cable core 22. With the fitting/connector 38 pressed into the receptacle 36, the leading end 42 of the fitting/connector 38 approaches, or can be abutted to, the housing surface 44 at the base of the receptacle 36. With the fitting/connector 38 fully inserted into the receptacle 36, solid or rolled pins 46, 48 can be pressed into housing bores 50, 52, respectively. The bores 50, 52 intersect the bore/receptacle 36 in a manner that the inserted pins 46, 48 are situated to abut the shoulder 40 to thereby prevent withdrawal of the fitting/connector 38, and thus the free cable end 34 to which it is attached, from the receptacle 36.

The fitting/connector 38 can be dimensioned so that it is capable of passing through the through bore 32. By passing the fitting/connector 38 and free cable end 34 through the through bore 32 in the direction of the arrow 54 in FIG. 2, the fitting/connector 38/cable free end 34 can be bent into a generally circular shape to allow the fitting/connector 38/free end 34 to be directed into the receptacle 36 and fixed using the pins 46, 48. The fixing operation does not require that the fitting/connector 38 be held entirely against any movement within the receptacle 36. A certain amount of play between the fitting/connector 38 and housing 18 is contemplated.

With the fitting/connector 38/cable free end 34 fixed, a loop 56 is formed by the cable 16 between the location at 58 at which the cable 16 projects from the through bore 32 and the location at 60 where it projects into the receptacle 36. The loop 56 has an effective diameter D4, which is variable between a maximum and minimum effective diameter by guidingly sliding the housing 18 along the length of the cable 16, i.e. moving the cable 16 within the through bore 32.

With the desired diameter D4 selected, as hereinafter described, a securing element 62 can be tightened to fix the loop size selected. The securing element 62 has a shank 64 which is threaded to cooperate with female threads on a bore 66 which extends from the face 68 of the housing 18 fully through to the through bore 32. The securing element 62 has an enlarged head 70 with a tamperproof tool fitting 74 thereon. The tool fitting 74 consists of a receptacle 76 with bounding flats 78 which produce a polygonal shape to be keyed with a complementary male-shaped tool end. At the center of the receptacle 76 is a projecting post 80. The operating tool (not shown) used to turn the securing element 62 must have a receptacle for the post 80 and must be configured to be keyed in the receptacle 76. Other tamper proof configurations are contemplated.

Using the appropriate tool, the securing element 62 can be selectively tightened and loosened. By tightening the securing element 62, the free end 82 thereof is borne forcibly against the outer surface 84 of the coating 24 on the cable 16. In a preferred form, the shank 64 tapers to a pointed free end 82. Accordingly, when the securing element 62 is tightened, the free end 82 digs into the outer surface 84, as shown most clearly in FIG. 7, thereby forming a localized indentation 86. The cooperation between the free end 82 and the indentation 86 causes a positive locking of the housing 18 to the cable 16 against lengthwise shifting therebetween so that the housing 18 can be selectively fixed at a plurality of different locations spaced along the length of the cable 16.

Figure 3:
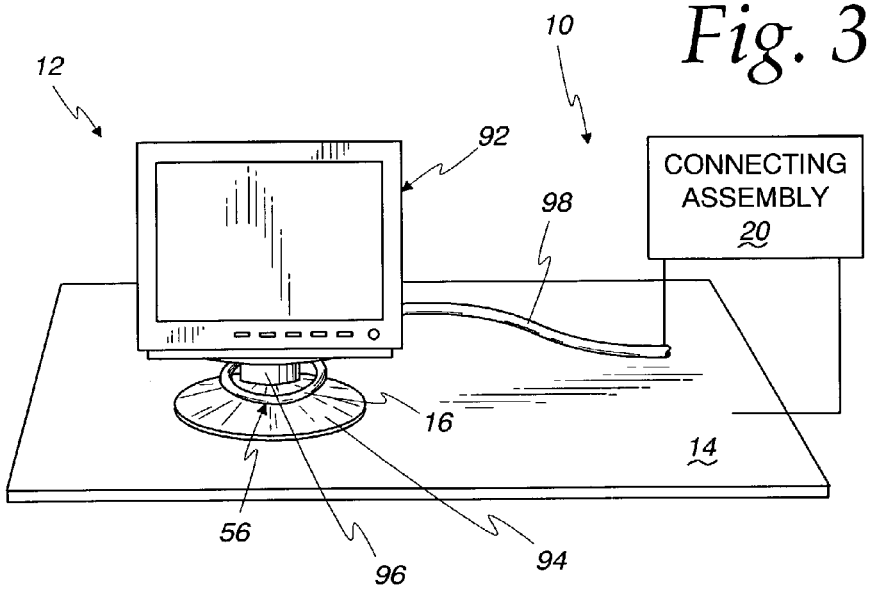
FIG. 3 is a partially schematic, perspective view of the inventive security system operatively connected to an exemplary object.
Figure 4:
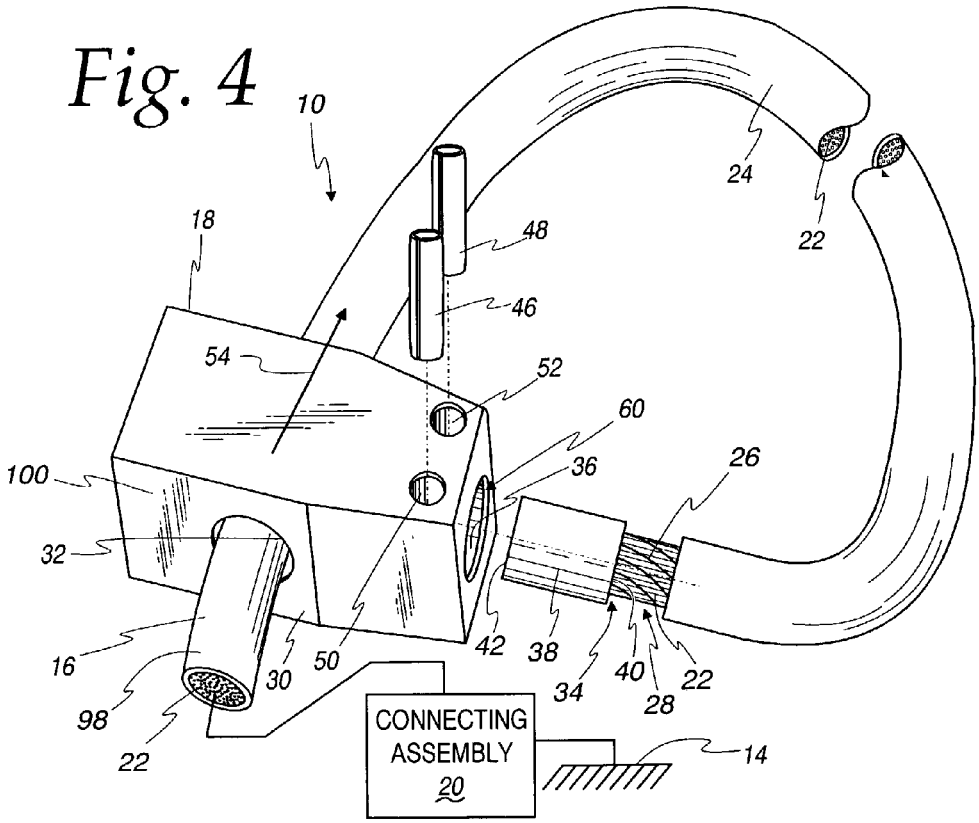
FIG. 4 is a partially schematic, exploded, perspective view of the security system of FIGS. 2 and 3.
Figure 5:
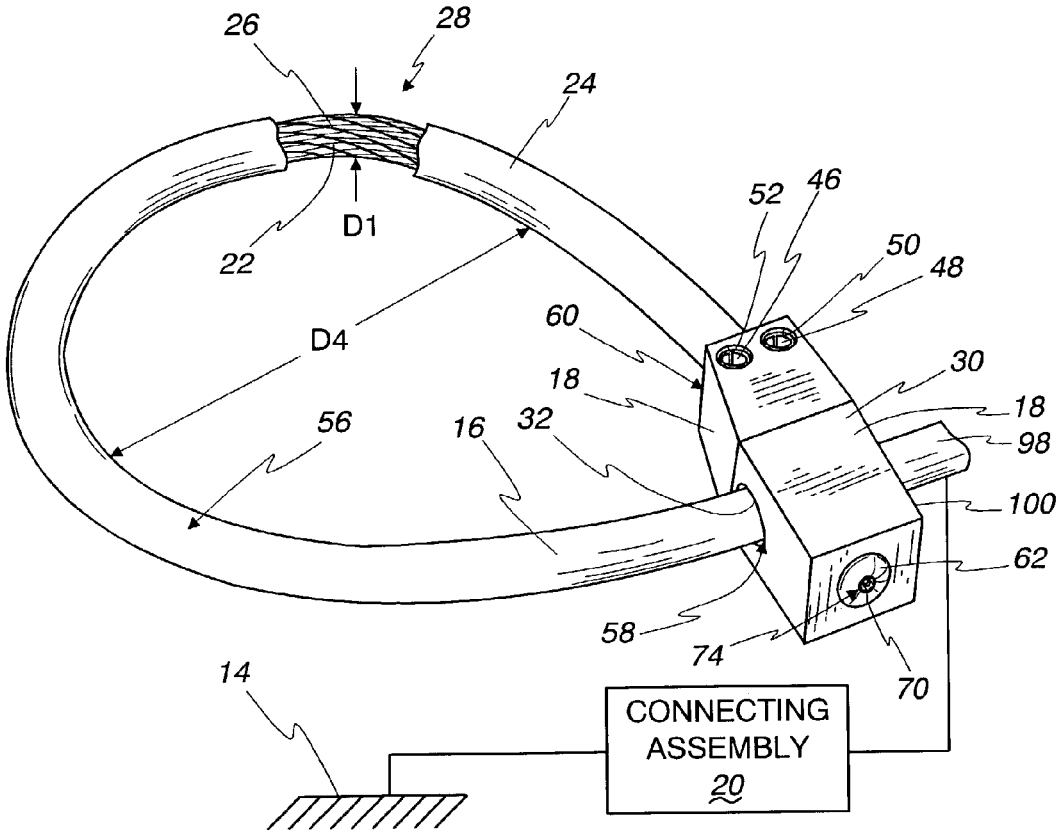
FIG. 5 is a view as in view FIG. 4 with the security system viewed from another perspective.
Figure 6:
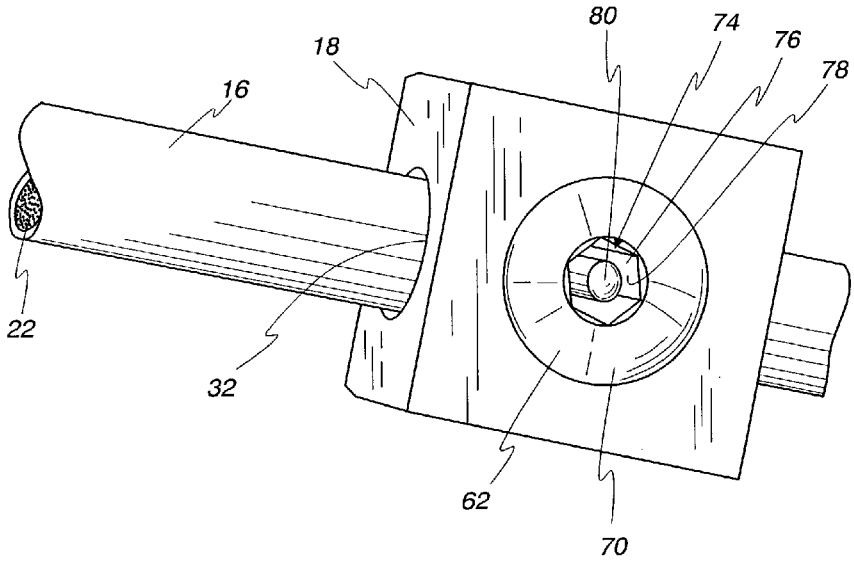
FIG. 6 is a fragmentary, perspective view of the security system of FIGS. 1–5 and showing a securing element which maintains the housing fixedly in a plurality of different locations along the length of the cable.
Figure 7:
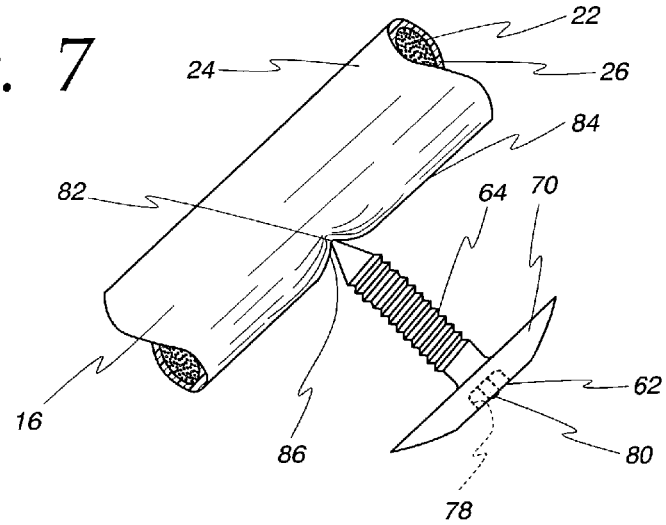
FIG. 7 is an enlarged, fragmentary view of a portion of the cable and showing the interaction of the free end of the securing element with the cable with the security element in a tightened state on the housing.

In a typical assembly operation, the cable 16 is directed through the housing through the bore 32 and bent into a generally circular shape by directing the fitting/connector 38 into the receptacle 36 and fixing the same by press fitting the pins 46, 48. The loop diameter D4 can then be expanded sufficiently to be placed around the particular object 12. As shown in FIG. 3, an exemplary object at 12 is shown as either a television or a computer monitor. The object 12 shown has a display component 92, a base 94, and a mounting post 96 connected between the display component 92 and the base 94. The mounting post 96 has a relatively small outer circumference compared to that of the display component 92 and the base 94. The loop 56 can thus be expanded sufficiently to either be directed down over the display component 92 or up from the base 94 to extend around the mounting post 96. By sliding the housing 18 along the cable 16, the diameter of the loop 56 can then be constricted so that it will not pass over either the display component 92 or the base 94. Once this loop diameter D4 is arrived at, the securing element 62 can be tightened to fix the loop diameter D4.

A portion 98 of cable 16 that extends away from the housing surface 100 can be suitably secured to the support 14 through the connecting assembly 20. The connecting assembly 20 can take any of a virtually limitless number of different forms. As just examples, the connecting assembly 104 may consist of a loop formed on the end of the cable 16 to be held to the support 14, as by a padlock, or the like. The end of the cable portion 98 can be secured as by a lockable cable box, as shown in U.S. Pat. No. 5,154,072, incorporated herein by reference. The cable end could be welded to a metal support or directed through a structure so that the connecting end is inaccessible to a person in the vicinity of the object 12.

The invention also contemplates that the loop 56 could be formed in situ, rather than preformed and merely enlarged and restricted, as described above. That is, the fitting/connector 38 could be installed after the free cable end is passed through the housing through bore 32.

As a still further variation, the shoulder 40 could be defined by the coating 24, obviating the need for a separate fitting/connector 38.

With the object 12 surrounded by the cable 16, the cable permits the object 12 to be repositioned within an area dictated by the length of the cable 16. While making the cable 16 with a relatively large diameter, the cable 16 offers an imposing impediment to a would-be thief. The hardened construction of the cable core 22 may also prevent severance thereof using conventional cutting tools.

The object 12 shown in FIG. 3 is only exemplary in nature. The loop 56 can be positioned around any suitable structure, as with a smaller circumference between two larger circumference portions. The larger circumference portions confine the loop 56 once reduced in diameter. The security system 10 can be also be installed on an object 12 having an enclosed opening through which the loop can be formed, as by the in situ formation process, described above.

The foregoing disclosure of specific embodiments is intended to be illustrative of the broad concepts comprehended by the invention.

What is claimed is:

1. In combination:

a) a security system for confining movement of an object to a predetermined area, the security system comprising:

a cable having a length; and a housing, the housing guidable slidingly along the length of the cable and capable of being fixed at a plurality of different locations spaced along the length of the cable, the cable having a first portion that can be fixed relative to the housing, whereby with the first portion fixed relative to the housing, the cable defines a loop with an effective diameter that is variable by sliding the housing along the length of the cable, the cable having a second portion, spaced from the loop, that is secured to a support relative to which an object is to be confined by the security system, the cable having a third portion that can be substantially fixed relative to the housing to substantially fix a selected effective diameter for the loop, wherein the housing comprises a body with a through bore through which the cable extends and through which the cable is slidable and a second bore defining a receptacle that receives the first portion of the cable, the through bore having a diameter, the through and second bores each have a central axis, and the central axes are at a substantial angle with respect to each other with the first and third portions of the cable fixed relative to the housing, wherein with the first portion of the cable in the receptacle, the housing is slidable along the cable between a first position wherein the loop has a minimum effective diameter and a second position wherein the loop has a maximum effective diameter, the housing capable of being fixed at any location along the length of the cable between the first and second positions, wherein the cable has a free end defining the first portion of the cable, the free end of the cable capable of being directed into and through the through bore and from there into the second bore, the cable having an outer surface with a substantially uniform diameter that is slightly less than the diameter of the through bore; and b) an object to be secured and having a portion with a reduced circumference that is surrounded by the loop defined by the cable so that the loop is confined at the portion of the object.

2. The combination according to claim 1 wherein the housing has a single piece in which the through bore and receptacle are defined.

3. The combination according to claim 1 wherein the free end of the cable comprises a fitting defining a shoulder and a first locking element is directed into the housing with the cable free end in the receptacle, the first locking element abutting to the shoulder to block the fitting in the receptacle.

4. The combination according to claim 3 further comprising a second locking element that is directed into the housing and abuts the shoulder to block the fitting in the receptacle.

5. The combination according to claim 1 wherein the housing is capable of being fixed at the plurality of different locations along the length of the cable by a securing element.

6. The combination according to claim 5 wherein the securing element comprises a threaded element that is threadably engaged with the housing.

7. The combination according to claim 6 wherein the threaded element has a free end that is borne directly against the cable to fix the housing at the plurality of different locations along the length of the cable.

8. The combination according to claim 7 wherein the threaded element tapers towards a point at the free end.

9. The combination according to claim 8 wherein the cable comprises a non-metal material that defines an outer surface of the cable and the free end of the threaded element digs into the outer surface to thereby fix the housing at the plurality of different locations along the length of the cable.

10. The combination according to claim 9 wherein the cable has a metal core and the non-metal material surrounds the metal core.

11. The combination according to claim 10 wherein the metal core comprises braided metal filaments.

12. The combination according to claim 10 wherein the metal core comprises a hardened material.

13. The combination according to claim 3 wherein the cable comprises a metal core and the fitting is crimped to the metal core.

14. The combination according to claim 1 wherein the housing is made from a non-metal material.

15. The combination according to claim 3 wherein the first locking element comprises a pin that is press fit into the housing.

16. The combination according to claim 1 wherein the object comprises one of a television and a computer monitor.

17. The combination according to claim 1 further comprising a connecting assembly for securing the second portion of the cable to a support relative to which an object is to be confined.

18. The combination according to claim 1 wherein the central axes are substantially orthogonal to each other.

19. The combination according to claim 1 wherein the cable has a core with a non-metal material surrounding the core, the non-metal material having an exposed surface with a substantially uniform diameter defining the loop and the third portion of the cable.

20. The combination according to claim 19 wherein the core comprises a metal material.

21. The combination according to claim 20 wherein the non-metal material comprises at least one of rubber and plastic.

22. The combination according to claim 19 wherein the free end of the cable comprises a fitting defining a shoulder facing lengthwise of the cable and the fitting can be directed axially into and through the through bore.

23. The combination according to claim 22 wherein the second bore comprises a blind bore and a locking element abuts to the shoulder to block the fitting in the receptacle.

24. The combination according to claim 23 wherein the housing is capable of being fixed along the length of the cable by a securing element that is threadably engaged with the housing.

25. The combination according to claim 24 wherein the securing element has an exposed head with a receptacle for a non-conventional, complementary operating tool that is used to turn the securing element.

26. The combination according to claim 25 wherein the non-metal material comprises at least one of rubber and plastic and the securing element digs into the non-metal material with the housing fixed along the cable through the securing element.

27. The combination according to claim 26 wherein the securing element has an axis about which the securing element is turned that is substantially parallel to the central axis of the second bore.

* * * * *